US007186942B1

(12) United States Patent
Slade et al.

(10) Patent No.: US 7,186,942 B1
(45) Date of Patent: Mar. 6, 2007

(54) THREE-POSITION VACUUM INTERRUPTER DISCONNECT SWITCH PROVIDING CURRENT INTERRUPTION, DISCONNECTION AND GROUNDING

(75) Inventors: Paul G. Slade, Ithaca, NY (US); Erik D. Taylor, Ithaca, NY (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/360,273

(22) Filed: Feb. 23, 2006

(51) Int. Cl.
*H01H 33/66* (2006.01)

(52) U.S. Cl. ..... 218/120; 218/140; 218/153

(58) Field of Classification Search ..... 218/118–121, 218/123–126, 134, 136, 137, 140, 152, 153–155, 218/7, 10, 14, 78, 84
See application file for complete search history.

(56) References Cited

U.S. PATENT DOCUMENTS

| | | | | |
|---|---|---|---|---|
| 3,571,543 | A * | 3/1971 | Perkins et al. | 218/10 |
| 3,671,696 | A * | 6/1972 | Brunner | 218/10 |
| 5,777,287 | A * | 7/1998 | Mayo | 218/123 |
| 5,905,242 | A * | 5/1999 | Bernard et al. | 218/16 |
| 6,529,009 | B2 * | 3/2003 | Kikukawa et al. | 218/10 |
| 6,720,515 | B2 | 4/2004 | Renz et al. | |

OTHER PUBLICATIONS

Kajiwara, Satoru, et al., "Development of 24-kV Switchgear with Multi-functional Vacuum Interrupters for Distribution," Hitachi Review, vol. 49, No. 2, 2000, pp. 93-100.
Jüttner, Burkhard, et al., "Instabilities of prebreakdown currents in vacuum I: late breakdowns," J. Phys. D: Appl. Phys. 32, 1999, pp. 2537-2543.
ABB Power Technologies S.p.A., "SHS2 Gas-Insulated switching and isolating apparatus", 2004, pp. i, 1-24, ii.

* cited by examiner

*Primary Examiner*—Elvin Enad
*Assistant Examiner*—M. Fishman
(74) *Attorney, Agent, or Firm*—Martin J. Moran

(57) ABSTRACT

A vacuum circuit interrupter includes a line conductor, a vacuum interrupter, a load conductor, a ground conductor and an operating mechanism. The vacuum interrupter includes a fixed conductor and a vacuum envelope containing a fixed contact and a movable contact movable between a closed circuit position in electrical connection with the fixed contact and an open circuit position spaced apart from the fixed contact. The fixed conductor is outside of the vacuum envelope and is electrically connected to the fixed contact. The load conductor is electrically connected to the movable contact. The operating mechanism is structured to: open and close the fixed and movable contacts, and move the vacuum interrupter and the fixed conductor thereof between a first position wherein the fixed conductor is electrically connected to the line conductor, and a second position wherein the fixed conductor is electrically connected to the ground conductor.

22 Claims, 8 Drawing Sheets

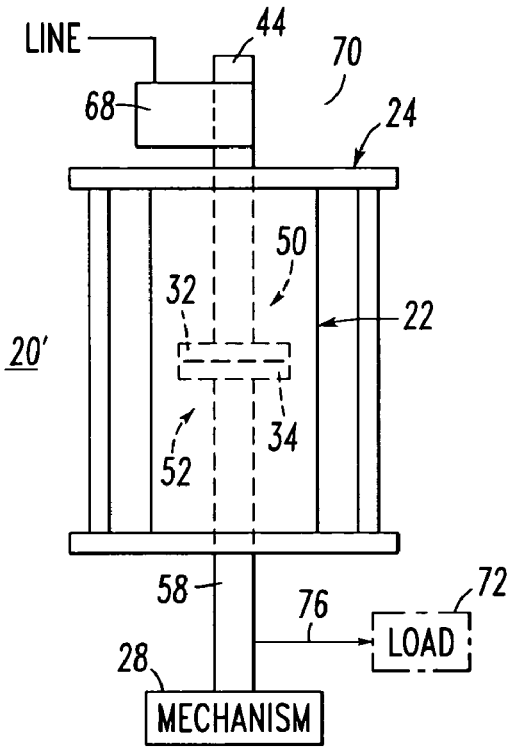
FIG.3A
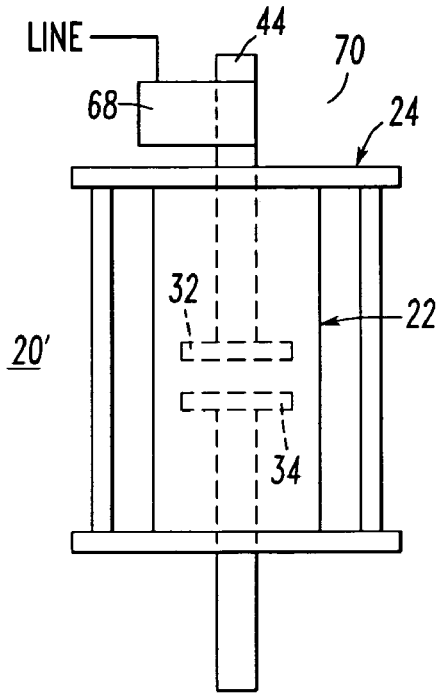
FIG.3B
FIG.3C
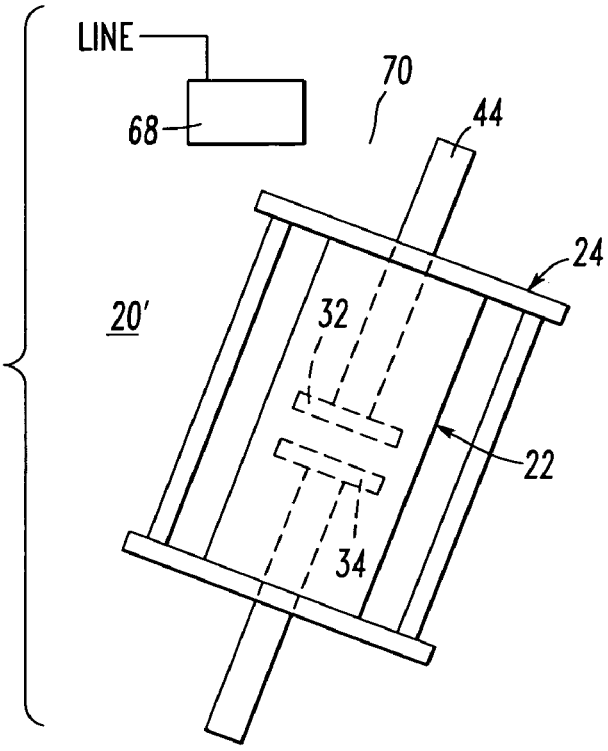

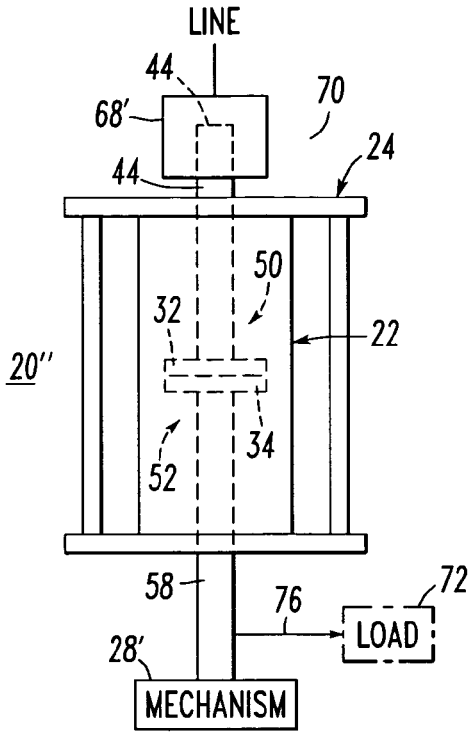
FIG.4A
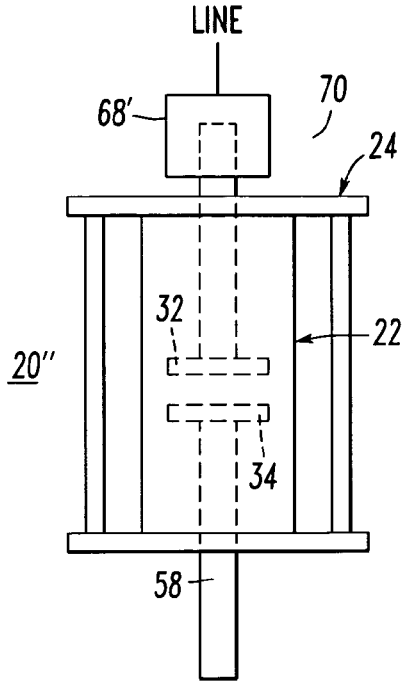
FIG.4B
FIG.4C
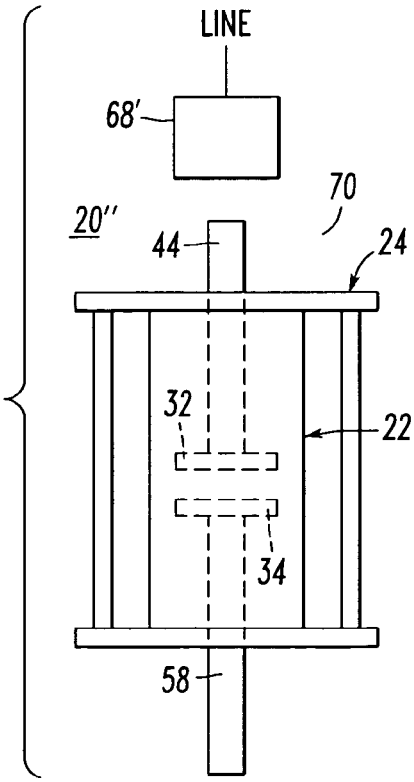

THREE-POSITION VACUUM INTERRUPTER DISCONNECT SWITCH PROVIDING CURRENT INTERRUPTION, DISCONNECTION AND GROUNDING

BACKGROUND OF THE INVENTION

1. Field of the Invention

This invention pertains generally to circuit interrupters and, more particularly, to vacuum circuit interrupters, such as, for example, vacuum circuit breakers. The invention also pertains to disconnect switches that provide a grounding function.

2. Background Information

Circuit interrupters provide protection for electrical systems from electrical fault conditions such as, for example, current overloads and short circuits. Typically, circuit interrupters include a spring powered operating mechanism which opens electrical contacts to interrupt the current through the conductors of an electrical system in response to abnormal conditions, although a wide range of mechanical or electromechanical driving mechanisms may be employed.

Vacuum circuit interrupters (e.g., vacuum circuit breakers; vacuum reclosers; other vacuum switching devices) include separable contacts disposed within an insulating housing. Vacuum circuit interrupters, such as, for example, power circuit breakers for systems operating above about 1,000 volts, typically utilize vacuum switches (not to be confused with vacuum switching devices), such as vacuum interrupters (not to be confused with vacuum circuit interrupters), as the switch element. Generally, one of the separable contacts is fixed relative to both the insulating housing and to an external electrical conductor which is interconnected with the circuit to be controlled by the vacuum circuit interrupter. The other separable contact is movable. The movable contact assembly usually comprises a stem of circular cross-section having the movable contact at one end enclosed within a vacuum envelope (e.g., vacuum chamber; vacuum bottle) of the vacuum interrupter and a driving mechanism at the other end which is external to the vacuum envelope. The driving mechanism provides the motive force to move the movable contact into or out of engagement with the fixed contact. Hence, the vacuum interrupter has two positions: on and off.

Vacuum interrupters are typically used, for instance, to reliably interrupt medium voltage alternating current (AC) currents and, also, high voltage AC currents of several thousands of amperes or more. Typically, one vacuum interrupter is provided for each phase of a multi-phase circuit and the vacuum interrupters for the several phases are actuated simultaneously by a common operating mechanism, or separately or independently by separate operating mechanisms.

It is known to provide a three-position switching and isolating apparatus, including gas-insulated switch-disconnectors and isolators, suitable for use in medium voltage switchgear. Blade contacts for closing, breaking, isolation and earthing are arranged inside a cylinder in sulfur hexafluoride ($SF_6$) gas typically at a pressure of about 202 kPa absolute. The blade contacts can take three positions: closed, open and earthed. Because of arcing considerations, such a three-position switching and isolating apparatus can generally interrupt or break only very modest levels of current. It is known to electrically connect such a three-position switching and isolating apparatus in series with a circuit breaker or fuse, which performs current interruption.

FIGS. 1A–1E show the series combination of a vacuum interrupter 2 and a disconnect switch 4 in closed, open, disconnected, intermediate and grounded positions, respectively. FIG. 1A shows the vacuum interrupter 2 and the series disconnect switch 4 in the closed position. FIG. 1B shows the vacuum interrupter 2 in the open position, in order to interrupt AC current 5, with the series disconnect switch 4 still being closed. The open (for interruption) position keeps all of the arcing inside the vacuum interrupter 2. FIG. 1C shows the vacuum interrupter 2 in the open position and the series disconnect switch 4 also being open to achieve full disconnection (i.e., isolation) of the load 6. FIG. 1D shows the series disconnect switch 4 in the grounded position, with the vacuum interrupter contacts 8 being open. In FIG. 1E, the vacuum interrupter 2 has moved to the closed position and the series disconnect switch 4 remains in the grounded position. Hence, the load side 10 of the vacuum interrupter 2 may be safely worked on.

Prior proposals incorporate a switching function (i.e., current interruption), a disconnection (of a line bus) function, and a grounding (of a load bus) function all in one vacuum envelope of a vacuum interrupter. See, for example, Kajiwara, Satoru, et al., "Development of 24-kV Switchgear with Multi-functional Vacuum Interrupters for Distribution," Hitachi Review, Vol. 49, No. 2, 2000, pp. 93–100; and U.S. Pat. No. 6,720,515. Such a vacuum interrupter has four positions: on, off, disconnect and earth. These prior proposals all have the inherent disadvantage that the open contact gap in the vacuum envelope has a finite probability of breaking down under a suitably high voltage pulse (e.g., a relatively high voltage pulse resulting from lightning). In addition, arcing products generated during current interruption could lead to a breakdown between the line and ground contacts, rather than the line and interruption contacts. Jüttner, "Instabilities of prebreakdown currents in vacuum I: late breakdowns," J. Phys. D: Appl. Phys. 32, pp. 2537–43 (1999).

If a breakdown were to occur during the disconnect function (i.e., after the off position but before the earth position of a four-position vacuum interrupter), then it would violate the standards requirements for dielectric coordination, and could potentially endanger personnel on the load side of the vacuum interrupter.

In addition, the four-position vacuum interrupters have a significantly more complicated design than current vacuum interrupter designs and would, therefore, be much more difficult to manufacture and be more expensive.

Accordingly, there is room for improvement in vacuum circuit interrupters.

There is a need for a vacuum circuit interrupter that reliably improves dielectric coordination and minimizes the chance of breakdown during a disconnect function, without significantly increasing total cost.

SUMMARY OF THE INVENTION

This need and others are met by the present invention, which combines the advantages of a conventional vacuum circuit interrupter as being a reliable and effective device to interrupt current with the reliable insulating performance of an insulating medium, such as, for example, air, sulfur hexafluoride ($SF_6$) or insulating oil.

In accordance with one aspect of the invention, a vacuum circuit interrupter comprises: a first conductor; a vacuum switch comprising: a second conductor, and a vacuum envelope containing a fixed contact assembly and a movable contact assembly movable between a closed circuit position in electrical connection with the fixed contact assembly and an open circuit position spaced apart from the fixed contact assembly, the second conductor being outside of the vacuum envelope, the second conductor being electrically connected to the fixed contact assembly; a third conductor electrically connected to the movable contact assembly; a fourth conductor; and an operating mechanism structured to: (a) open and close the fixed contact assembly and the movable contact assembly of the vacuum switch, and (b) move the vacuum switch and the second conductor thereof between a first position wherein the second conductor is electrically connected to the first conductor, and a second position wherein the second conductor is electrically connected to the fourth conductor.

The movable contact assembly of the vacuum switch may include a longitudinal axis; the operating mechanism may be structured to, first, open the fixed contact assembly and the movable contact assembly by moving the movable contact assembly along the longitudinal axis and away from the fixed contact assembly and to, second, rotate the vacuum switch and the second conductor thereof away from the first position wherein the second conductor is electrically connected to the first conductor and toward the second position wherein the second conductor is electrically connected to the fourth conductor.

The operating mechanism may be further structured to, third, close the fixed contact assembly and the movable contact assembly by moving the movable contact assembly along the longitudinal axis and toward the fixed contact assembly.

The movable contact assembly of the vacuum switch may include a longitudinal axis; the operating mechanism may be structured to, first, open the fixed contact assembly and the movable contact assembly by moving the movable contact assembly along the longitudinal axis and away from the fixed contact assembly, to, second, move the vacuum switch and the second conductor thereof along the longitudinal axis and away from the first conductor, and to, third, rotate the vacuum switch and the second conductor thereof toward the second position wherein the second conductor is electrically connected to the fourth conductor.

The operating mechanism may be further structured to, fourth, close the fixed contact assembly and the movable contact assembly by moving the movable contact assembly along the longitudinal axis and toward the fixed contact assembly.

The operating mechanism may be structured to provide movement among: a closed position wherein the second conductor is electrically connected to the first conductor and the fixed contact assembly is electrically connected to the movable contact assembly of the vacuum switch, an open position wherein the second conductor is electrically connected to the first conductor and the fixed contact assembly is electrically disconnected from the movable contact assembly of the vacuum switch, a disconnected position wherein the second conductor is electrically disconnected from the first conductor and the fixed contact assembly is electrically disconnected from the movable contact assembly of the vacuum switch, a transitional position wherein the second conductor is electrically disconnected from the first conductor, the fixed contact assembly is electrically disconnected from the movable contact assembly of the vacuum switch, and the second conductor is electrically connected to the fourth conductor, and a grounded position wherein the second conductor is electrically disconnected from the first conductor, the fixed contact assembly is electrically connected to the movable contact assembly of the vacuum switch, and the second conductor is electrically connected to the fourth conductor.

The operating mechanism may be structured to provide movement among: a closed position wherein the second conductor is electrically connected to the first conductor and the fixed contact assembly is electrically connected to the movable contact assembly of the vacuum switch, a disconnected position wherein the second conductor is electrically disconnected from the first conductor and the fixed contact assembly is electrically disconnected from the movable contact assembly of the vacuum switch, and a grounded position wherein the second conductor is electrically disconnected from the first conductor, the fixed contact assembly is electrically connected to the movable contact assembly of the vacuum switch, and the second conductor is electrically connected to the fourth conductor.

As another aspect of the invention, a vacuum circuit interrupter comprises: a first conductor including a contact portion; a vacuum switch comprising: a first vacuum envelope containing a fixed contact assembly and a movable contact assembly movable between a closed circuit position in electrical connection with the fixed contact assembly and an open circuit position spaced apart from the fixed contact assembly, and a second conductor electrically connected to the fixed contact assembly, the second conductor including a contact portion; a third conductor electrically connected to the movable contact assembly; a fourth conductor including a contact portion, the contact portions of the first, second and fourth conductors being outside of the vacuum envelope; an operating mechanism structured to: (a) open and close the fixed contact assembly and the movable contact assembly of the vacuum switch, and (b) move the vacuum switch and the second conductor thereof between a first position wherein the contact portion of the second conductor is electrically connected to the contact portion of the first conductor, and a second position wherein the contact portion of second conductor is electrically connected to the contact portion of the fourth conductor; and a second envelope containing at least the contact portions of the first, second and fourth conductors.

The second envelope may further contain an insulating medium.

As another aspect of the invention, a vacuum circuit interrupter comprises: a first conductor; a vacuum switch comprising: a second conductor, a vacuum envelope including a first end and a second end, the vacuum envelope containing a fixed contact assembly proximate the first end of the vacuum envelope and substantially containing a movable contact assembly proximate the second end of the vacuum envelope, the movable contact assembly movable between a closed circuit position in electrical connection with the fixed contact assembly and an open circuit position spaced apart from the fixed contact assembly, the second conductor being outside of the vacuum envelope, the second conductor being electrically connected to the fixed contact assembly, a first member outside of the vacuum envelope, the first member being structured to support the first end of the vacuum envelope, a second member outside of the vacuum envelope, the second member being structured to support the second end of the vacuum envelope, and a number of insulating support members outside of the vacuum envelope and disposed between the first and second members; a third conductor electrically connected to the movable contact assembly; a fourth conductor; and an operating mechanism structured to: (a) open and close the fixed contact assembly and the movable contact assembly of the vacuum switch, and (b) move the vacuum switch and the second conductor thereof between a first position wherein the second conductor is electrically connected to the first conductor, and a second position wherein the second conductor is electrically connected to the fourth conductor.

The first member may include a first opening; the second member may include a second opening; the second conductor may pass through the first opening of the first member; and a portion of the movable contact assembly may pass through the second opening of the second member.

BRIEF DESCRIPTION OF THE DRAWINGS

A full understanding of the invention can be gained from the following description of the preferred embodiments when read in conjunction with the accompanying drawings in which:

FIGS. 3A–3E are block diagrams of a vacuum interrupter disconnect switch in accordance with another embodiment of the invention in closed, open, disconnected, transitional and grounded positions, respectively.

FIGS. 4A–4E are block diagrams of a vacuum interrupter disconnect switch in accordance with another embodiment of the invention in closed, open, disconnected, transitional and grounded positions, respectively.

DESCRIPTION OF THE PREFERRED EMBODIMENTS

As employed herein, the term "number" shall mean one or an integer greater than one (i.e., a plurality).

As employed herein, the statement that a part is "electrically interconnected with" one or more other parts shall mean that the parts are directly electrically connected together or are electrically connected together through one or more electrical conductors or generally electrically conductive intermediate parts. Further, as employed herein, the statement that a part is "electrically connected to" one or more other parts shall mean that the parts are directly electrically connected together or are electrically connected together through one or more electrical conductors. Also, as employed herein, the statement that two parts are "directly electrically connected together by" another part shall mean that the two parts are directly electrically connected together by only such other part.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The present invention is described in association with a vacuum interrupter disconnect switch, although the invention is applicable to a wide range of vacuum circuit interrupters.

EXAMPLE 1

Figure 1A:
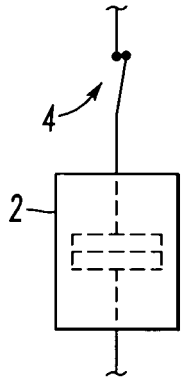
FIG. 1A PRIOR ART
FIGS. 1A–1E are block diagrams of the series combination of a vacuum interrupter and a disconnect switch in closed, open, disconnected, intermediate and grounded positions, respectively.
Figure 1B:
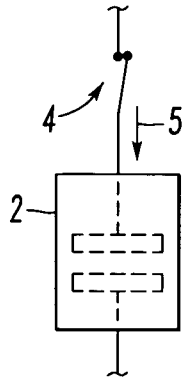
FIG. 1B PRIOR ART
Figure 1C:
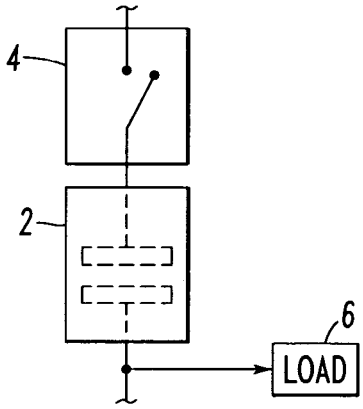
FIG. 1C PRIOR ART
Figure 1D:
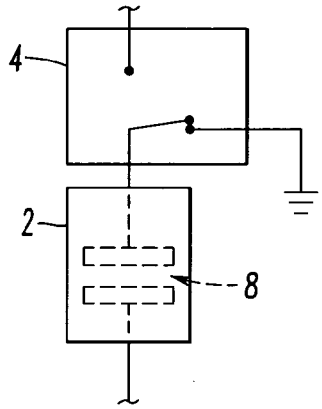
FIG. 1D PRIOR ART
Figure 1E:
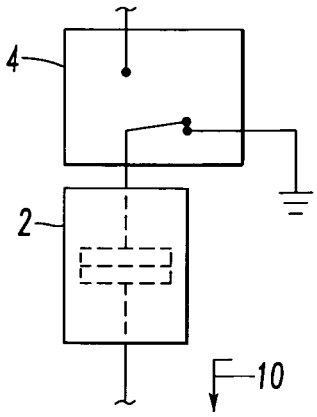
FIG. 1E PRIOR ART
Figure 2:
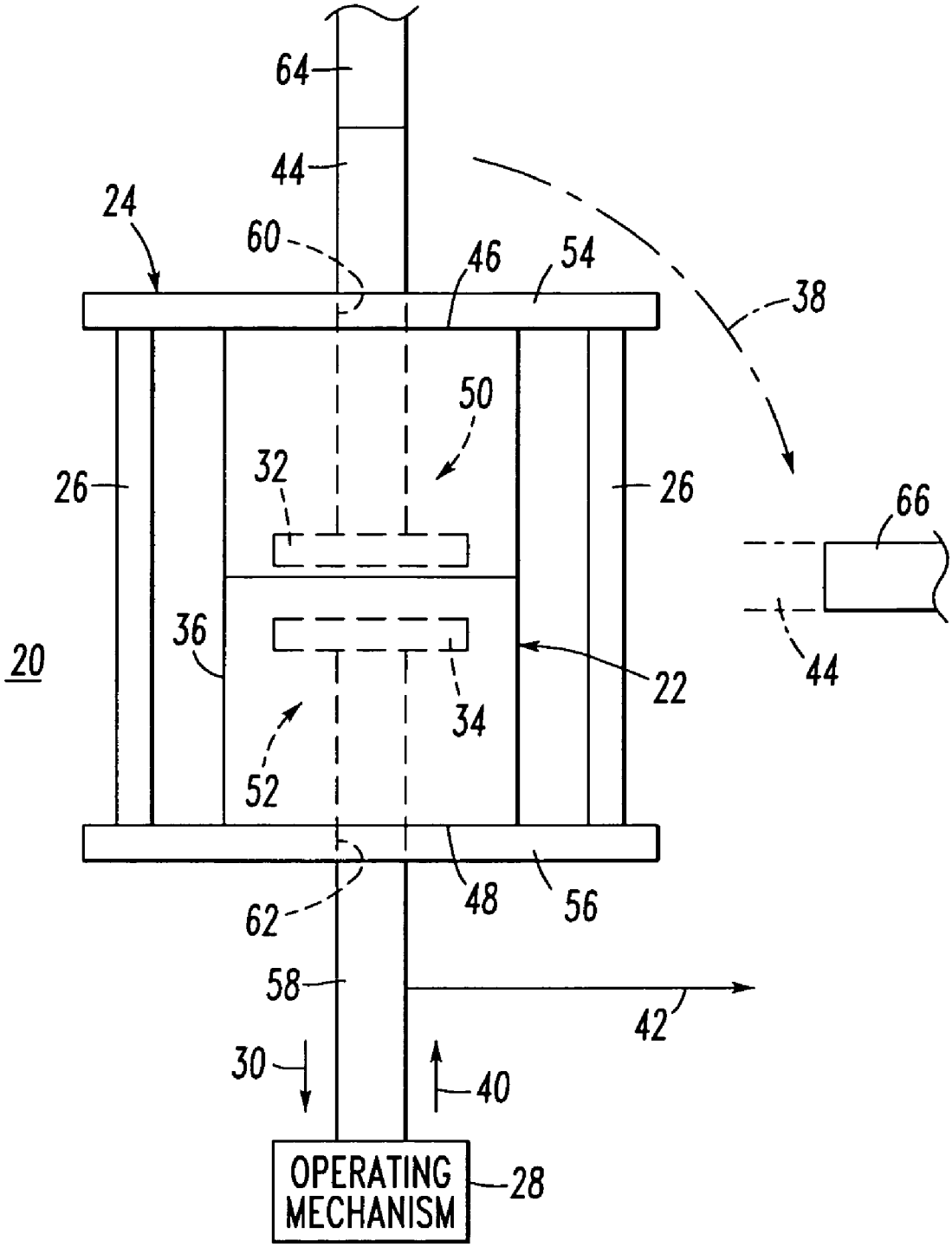
FIG. 2 is a vertical elevation view of a vacuum interrupter disconnect switch including a vacuum interrupter enclosed in an insulating cage having plural insulating support rods in accordance with the present invention.

FIG. 2 shows a vacuum interrupter disconnect switch 20 including a vacuum switch, such as vacuum interrupter 22, enclosed in a suitable insulating cage 24 having a number of insulating members, such as a plurality of insulating support rods 26. Although plural rods 26 are shown, any suitable insulating support member(s) may be employed, such as, for example, that encapsulate the vacuum interrupter 22 in a rigid epoxy resin housing, or such as an insulating support cylinder (not shown). The combined vacuum interrupter 22 and insulating cage 24 is coupled to a suitable operating mechanism 28 in such a way that the operating mechanism provides an initial longitudinal motion (e.g., downward with respect to FIG. 2 as shown by arrow 30) to open the fixed contact 32 (shown in hidden line drawing) and the movable contact 34 (shown in hidden line drawing) inside the vacuum envelope 36, thereby interrupting the circuit current. Then, after this has been achieved, the operating mechanism 28 rotates the combined vacuum interrupter 22 and insulating cage 24 (e.g., clockwise with respect to FIG. 2 as shown by arrow 38), and finally closes the vacuum interrupter contacts 32,34 (which are shown open in FIG. 2), by providing a final longitudinal motion (e.g., along the axis of movable stem 58 toward fixed contact 32 of FIG. 2 as shown by arrow 40). For example, the rotation of the combined vacuum interrupter 22 and insulating cage 24 may occur at relatively low speeds as compared to the conventional opening and closing speeds of the vacuum interrupter contacts 32,34.

The vacuum interrupter 22 also includes a conductor 44 electrically connected to the fixed contact 32. The vacuum envelope 36 includes a first end 46 and a second end 48. The conductor 44 is outside of the vacuum envelope 36 and is electrically connected to the fixed contact assembly 50 in a manner well known to those skilled in the art. The vacuum envelope 36 contains a fixed contact assembly 50 including the fixed contact 32 proximate the first end 46 of the vacuum envelope 36 and substantially contains a movable contact assembly 52 including the movable contact 34 proximate the second end 48 of the vacuum envelope 36. In a manner well known to those skilled in the art, the movable contact assembly 52 is movable between a closed circuit position (not shown in FIG. 2) in electrical connection with the fixed contact assembly 50 and an open circuit position (as shown in FIG. 2) spaced apart from the fixed contact assembly 50.

The insulating cage 24 includes a first member 54 (e.g., conductive; non-conductive) outside of the vacuum envelope 36 and being structured to support the first end 46 of the vacuum envelope 36. The insulating cage 24 also includes a second member 56 (e.g., conductive; non-conductive) outside of the vacuum envelope 36 and being structured to support the second end 48 of the vacuum envelope 36. The insulating rods 26 are also outside of the vacuum envelope 36 and are disposed between the first and second members 54,56. The rods 26 and the members 54,56 cooperate to mechanically support the vacuum envelope 36. Outside of the vacuum envelope 36, the operating mechanism 28 engages the movable stem 58 of the movable contact assembly 52, in order to move the same in the longitudinal directions shown by the arrows 30,40. Preferably, outside of the vacuum envelope 36, the operating mechanism 28 engages the insulating cage 24, in order to move the same and the vacuum envelope 36 in the rotational direction shown by the arrow 38 without providing any undue mechanical stress on the vacuum envelope 36.

The first member 54 includes a first opening 60 and the second member 56 includes a second opening 62. The conductor 44, which is electrically connected to the fixed contact assembly 50, passes through the first opening 60. A portion of the movable contact assembly 52 and, in particular, the movable stem 58, passes through the second opening 62.

The operating mechanism 28 is structured to: (a) open and close the fixed contact assembly 50 and the movable contact assembly 52 of the vacuum interrupter 22 by moving the movable stem 58 in the directions shown by the arrows 30 and 40, respectively, and (b) move the vacuum interrupter 22, insulating cage 24 and the conductor 44 thereof between a first position (as shown in FIG. 2) wherein the conductor 44 is electrically connected to a conductor (e.g., line) 64, and a second position (shown in phantom line drawing) wherein the conductor 44 is electrically connected to another conductor (e.g., ground) 66.

EXAMPLE 2

Figure 3D:
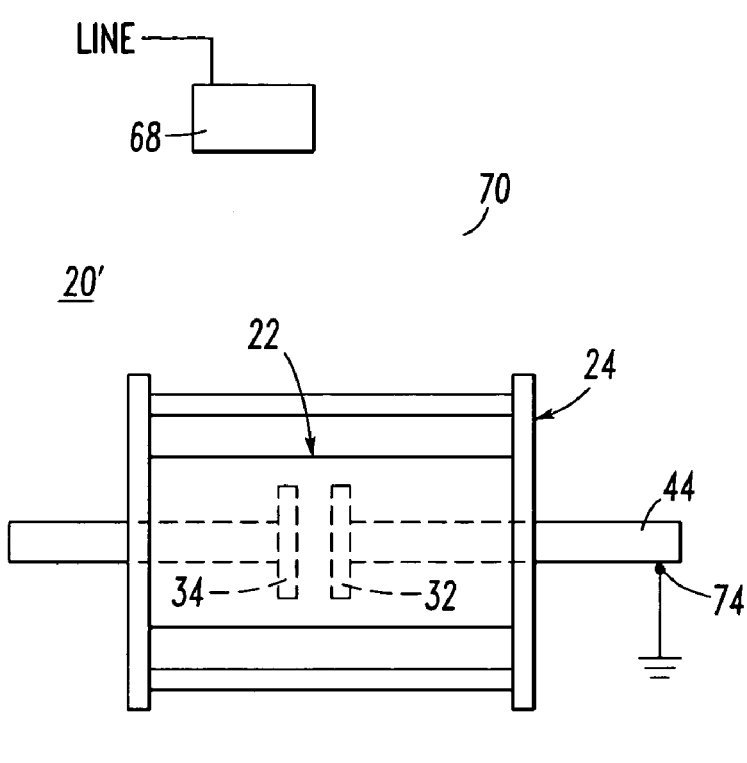

FIGS. 3A–3E show the operation of a vacuum interrupter disconnect switch 20', which is somewhat similar to the switch 20 of FIG. 2. FIG. 3A shows the vacuum interrupter 22, insulating cage 24 and a series switch formed by conductor 44 and a line conductor, such as terminal 68, in a suitable insulating medium, such as air 70, in the closed position.

In FIG. 3B, the vacuum interrupter 22 is in the open position. The operating mechanism 28 (shown in FIG. 3A) pulls the contacts 32,34 of the vacuum interrupter 22 open and the AC current is interrupted, with the series switch formed by conductor 44 and terminal 68 still being closed. The operating mechanism 28 opens the fixed contact assembly 50 and the movable contact assembly 52 by moving the movable contact assembly 52 along a longitudinal axis defined by the movable stem 58 and away from the fixed contact assembly 50.

FIG. 3C shows the whole vacuum interrupter 22 and insulating cage 24 being rotated away from its electrical connection to the line side power bus at terminal 68. The operating mechanism 28 (FIG. 3A) rotates the vacuum interrupter 22, insulating cage 24 and conductor 44 away from the position of FIGS. 3A and 3B to the disconnected (i.e., isolated) position of FIG. 3C. This rotation provides a suitably large gap between the fixed end conductor 44 of the vacuum interrupter 22 and the line side terminal 68 in order to give effective disconnection (i.e., isolation), which depends upon the insulating medium, which in this example is air 70. Thus, the vacuum interrupter 22 is in the open position and the series switch formed by conductor 44 and terminal 68 in the insulating medium air 70 is also open to achieve full disconnection of the load 72 (shown in FIG. 3A).

FIG. 3D shows the vacuum interrupter disconnect switch 20' in a transitional position, in which the fixed end conductor 44 of the vacuum interrupter 22 is electrically connected to and grounded by a ground conductor 74, and the vacuum interrupter contacts 32,34 are open. From the position of FIG. 3C, the operating mechanism 28 (FIG. 3A) further rotates the vacuum interrupter 22, insulating cage 24 and conductor 44 away from the position of FIG. 3C to the transitional position of FIG. 3D in which the conductor 44 is electrically connected to the ground conductor 74.

Figure 3E:
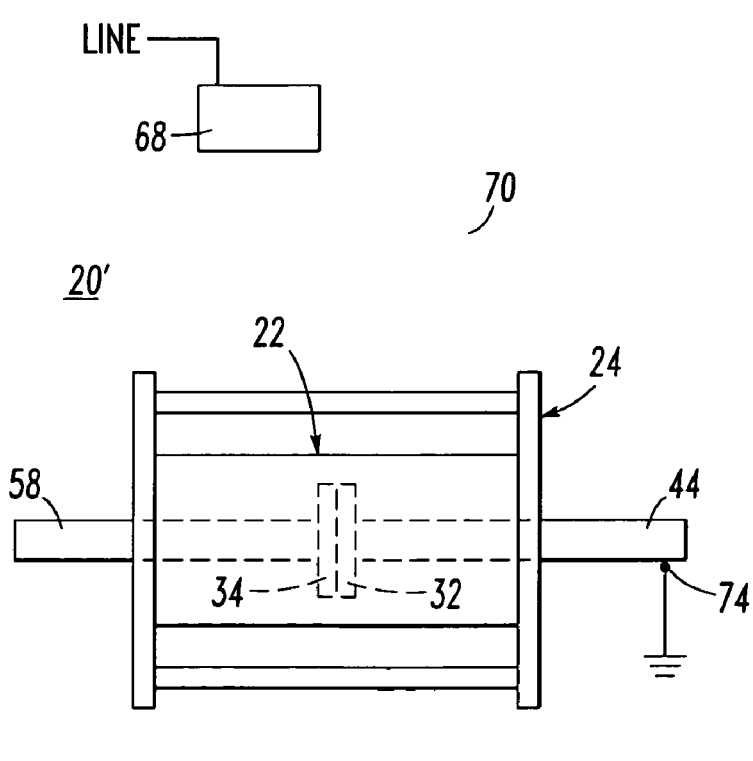

In FIG. 3E, the vacuum interrupter contacts 32,34 are in the closed position and the fixed end conductor 44 of the vacuum interrupter 22 is still grounded, at ground conductor 74. Hence, the load side stem 58 is grounded. The operating mechanism 28 (FIG. 3A) closes the fixed contact assembly 50 and the movable contact assembly 52 by moving the movable contact assembly 52 along the longitudinal axis defined by the movable stem 58 toward the fixed contact assembly 50. The load side stem 58 is also electrically connected to the load 72 (FIG. 3A) by a conductor 76 (FIG. 3A). Thus, the load 72 is grounded and may be safely worked on.

The vacuum interrupter disconnect switch 20', thus, provides three functions: (1) switching (FIGS. 3A and 3B); (2) disconnection (i.e., isolation) (FIG. 3C); and (3) grounding (FIGS. 3D and 3E) using one operating mechanism 28 and one vacuum interrupter 22. From the user standpoint, the most important positions are closed (FIG. 3A), disconnected (FIG. 3C) and grounded (FIG. 3E). Hence, the open (for interruption) position (FIG. 3B) may be a position intermediate the closed position (FIG. 3A) and the disconnected position (FIG. 3C). The operating mechanism 28 returns the vacuum interrupter disconnect switch 20' from the grounded position (FIG. 3E) to the closed position (FIG. 3A) by following the opposite sequence of positions as sequentially shown in FIGS. 3E, 3D, 3C, 3B and 3A.

EXAMPLE 3

Figure 4D:
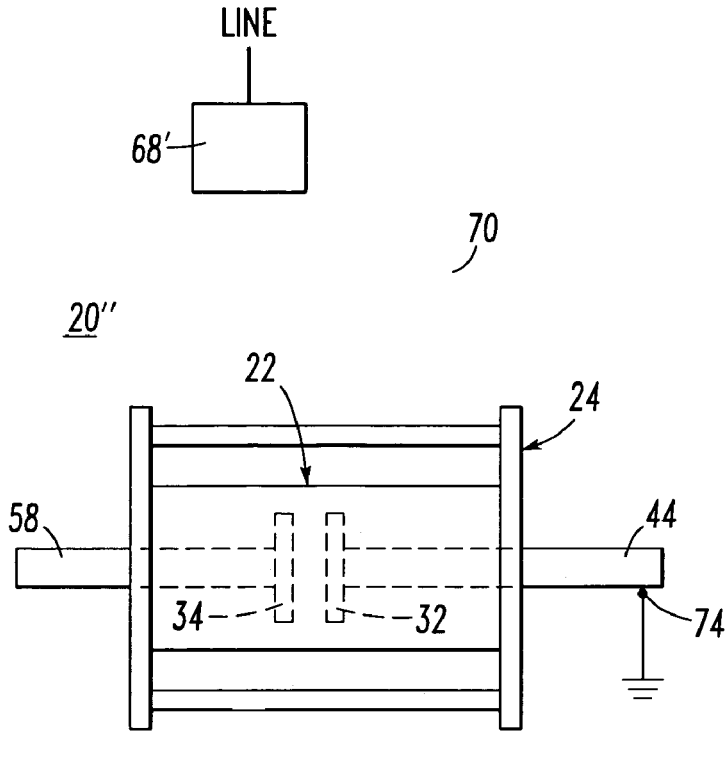

FIGS. 4A–4E show the operation of a vacuum interrupter disconnect switch 20", which is somewhat similar to the switch 20' of FIGS. 3A–3E. FIG. 4A shows the vacuum interrupter 22, insulating cage 24 and a series switch formed by conductor 44 and a line conductor, such as terminal 68', in a suitable insulating medium, such as air 70, in the closed position.

In FIG. 4B, the vacuum interrupter 22 is in the open position. The operating mechanism 28' (FIG. 4A) pulls open the contacts 32,34 of the vacuum interrupter 22 and the AC current is interrupted, with the series switch formed by conductor 44 and terminal 68' still being closed. The operating mechanism 28' opens the fixed contact assembly 50 and the movable contact assembly 52 by moving the movable contact assembly 52 along the longitudinal axis defined by the movable stem 58 and away from the fixed contact assembly 50.

Figure 4E:
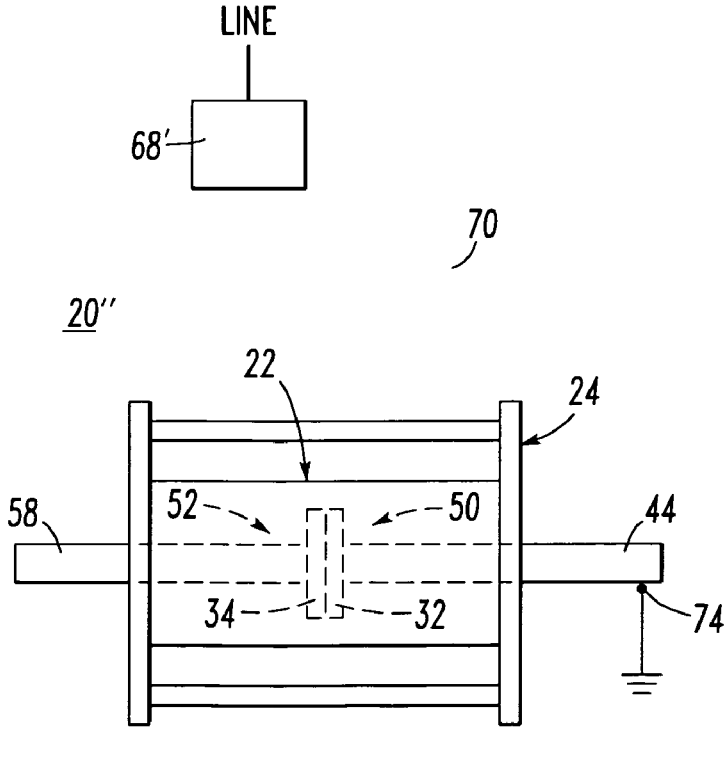

Unlike FIG. 3C, FIG. 4C shows the insulating cage 24, vacuum interrupter 22 and conductor 44 being longitudinally moved away from its electrical connection to the line side power bus at terminal 68'. Here, the disconnection (i.e., isolation) is achieved by moving the combined vacuum interrupter 22, insulating cage 24 and conductor 44 downward (with respect to FIG. 4C) along the longitudinal axis defined by the movable stem 58 and away from the terminal 68'. This occurs before the operating mechanism 28' rotates the combined vacuum interrupter 22, insulating cage 24 and conductor 44 into the transitional position (FIG. 4D) after which the interrupter contacts 32,34 are closed (FIG. 4E). The downward (with respect to FIG. 4C) longitudinal movement provides a suitably large gap between the conductor 44 at the fixed end of the vacuum interrupter 22 and the line side terminal 68' in order to give an effective disconnection (i.e., isolation), the degree of which depends upon the insulating medium, such as air 70. Thus, the vacuum interrupter 22 is in the open position and the series switch formed by conductor 44 and terminal 68' is also open to achieve full disconnection of the load 72 (FIG. 4A).

FIG. 4D shows the series switch formed by conductor 44 and ground terminal 74 in the grounded position. The operating mechanism 28' rotates the vacuum interrupter 22, insulating cage 24 and conductor 44 to the position shown in FIG. 4D wherein the conductor 44 is electrically connected to the ground conductor 74. In this transitional position, the fixed end conductor 44 of the vacuum interrupter 22 is grounded and the vacuum interrupter contacts 32,34 are open.

In FIG. 4E, the vacuum interrupter 22 is in the closed position and the series switch formed by conductor 44 and ground terminal 74 is still in the grounded position. Hence, the load side stem 58 is grounded. The operating mechanism 28' (FIG. 4A) closes the fixed contact assembly 50 and the movable contact assembly 52 by moving the movable contact assembly 52 along the longitudinal axis defined by the movable stem 58 toward the fixed contact assembly 50. The load side stem 58 is also electrically connected to the load 72 (FIG. 4A) by a conductor 76 (FIG. 4A). Thus, the load 72 is grounded and may be safely worked on.

The vacuum interrupter disconnect switch 20", thus, provides three functions: (1) switching (FIGS. 4A and 4B); (2) disconnection (i.e., isolation) (FIG. 4C); and (3) grounding (FIGS. 4D and 4E) using one operating mechanism 28' and one vacuum interrupter 22. From the user standpoint, the most important positions are closed (FIG. 4A), disconnected (FIG. 4C) and grounded (FIG. 4E). Hence, the open (for interruption) position (FIG. 4B) may be a position intermediate the closed position (FIG. 4A) and the disconnected position (FIG. 4C). The operating mechanism 28' returns the vacuum interrupter disconnect switch 20" from the grounded position (FIG. 4E) to the closed position (FIG. 4A) by following the opposite sequence of positions as sequentially shown in FIGS. 4E, 4D, 4C, 4B and 4A.

EXAMPLE 4

Figure 5:
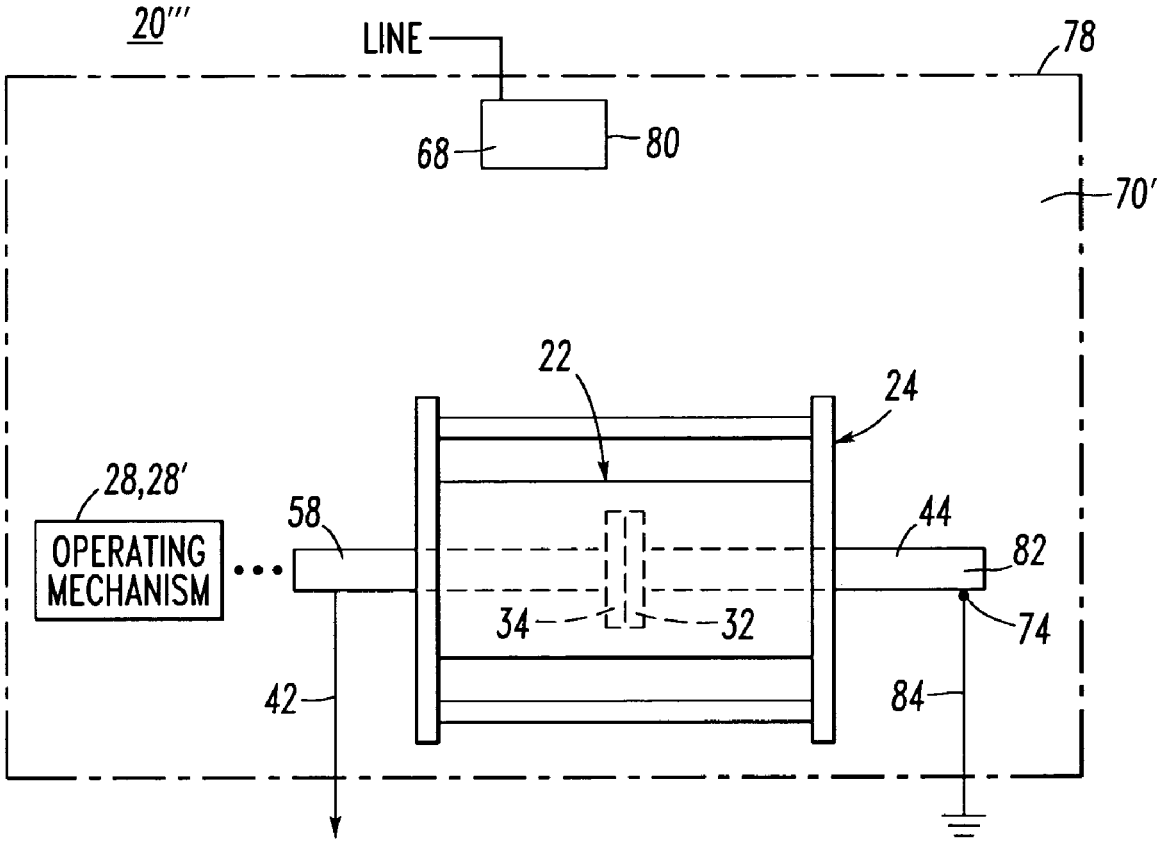
FIG. 5 is a block diagram of a vacuum interrupter disconnect switch in accordance with another embodiment of the invention in a grounded position.

FIG. 5 shows the grounded position of a vacuum interrupter disconnect switch 20'", which is somewhat similar to the switch 20' of FIGS. 3A–3E. The main difference, however, is that rather than employing an insulating medium such as air 70 (e.g., in the atmosphere, without being contained in an envelope), a different insulating medium 70' is employed in an envelope 78. As non-limiting examples, the insulating medium 70' may be, for example, insulating oil as employed in electrical transformers and oil-based switches, another type of insulating oil, or sulfur hexafluoride ($SF_6$). As another example, air or another suitable gas, such as dry nitrogen ($N_2$) or a combination of $SF_6$ and $N_2$, may be employed in the envelope 78.

As shown in FIG. 5, the conductors 68, 44 and 74 include respective contact portions which are generally shown at 80, 82 and 84. The envelope 78 contains at least the contact portions 80,82,84 of the respective conductors 68,44,74. In this example, the envelope 78 also contains the operating mechanism 28, the vacuum interrupter 22 and the insulating cage 24. It will be appreciated that the vacuum interrupter disconnect switch 20'" has closed, open, disconnected and transitional positions, which are similar to the corresponding positions of the switch 20' of respective FIGS. 3A–3D. It will also be appreciated that the envelope 78 and insulating medium 70' may be employed with the vacuum circuit interrupter 20" of FIGS. 4A–4E or the vacuum circuit interrupter 20"" of FIGS. 6A–6C.

EXAMPLE 5

Figure 6A:
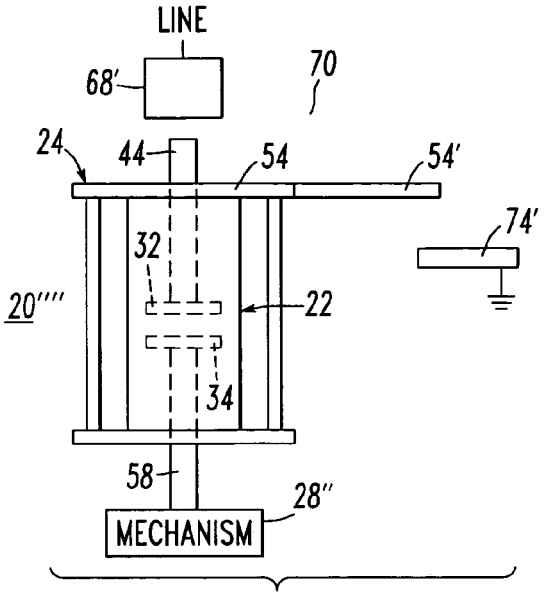
FIGS. 6A–6C are block diagrams of a vacuum interrupter disconnect switch in accordance with another embodiment of the invention in disconnected, transitional and grounded positions, respectively.
Figure 6B:
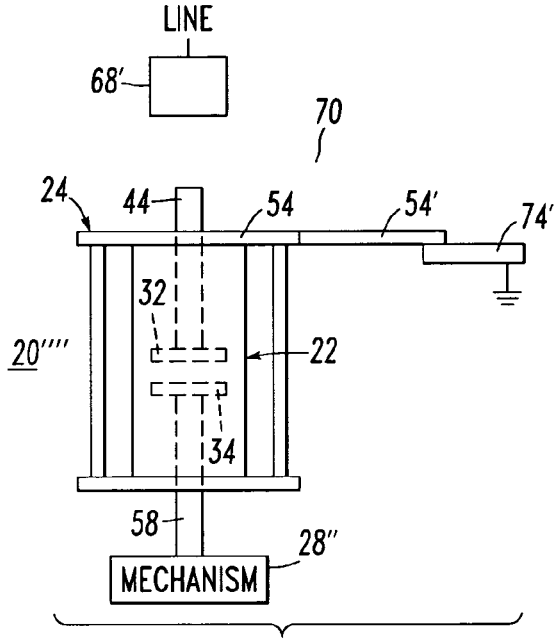
Figure 6C:
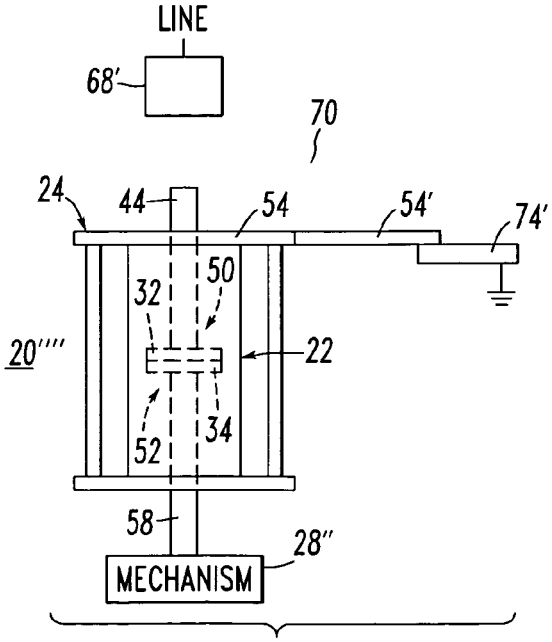

FIGS. 6A–6C show the operation of a vacuum interrupter disconnect switch 20"", which is somewhat similar to the switch 20" of FIGS. 4A–4E. The closed and open positions (not shown) of the switch 20"" are the same as the respective closed and open positions (FIGS. 4A–4B) of the switch 20". Just like FIG. 4C, FIG. 6A shows the insulating cage 24, vacuum interrupter 22 and conductor 44 being longitudinally moved away from its electrical connection to the line side power bus at terminal 68'. Here, the disconnection (i.e., isolation) is achieved by moving the combined vacuum interrupter 22, insulating cage 24 and conductor 44 downward (as shown in FIG. 6A) along the longitudinal axis defined by the movable stem 58 and away from the terminal 68'. This occurs before the operating mechanism 28" further moves the combined vacuum interrupter 22, insulating cage 24 and conductor 44 into the transitional position (FIG. 6B) after which the interrupter contacts 32,34 are closed (FIG. 6C). The downward (with respect to FIG. 6A) longitudinal movement provides a suitably large gap between the conductor 44 at the fixed end of the vacuum interrupter 22 and the line side terminal 68' in order to give an effective disconnection (i.e., isolation), the degree of which depends upon the insulating medium, such as air 70. Thus, the vacuum interrupter 22 is in the open position and the series switch formed by conductor 44 and terminal 68' is also open to achieve full disconnection of the load 72 (FIG. 4A).

FIG. 6B shows the series switch formed by conductors 44 and 54' and ground terminal 74' in the grounded position. In this embodiment, the member 54 is a conductor, conductors 44, 54 and 54' are electrically connected, and conductor 54' (e.g., without limitation, a conductive rod; a conductive plate) is extended from conductor 54. Alternatively, the member 54 need not be a conductor, the conductors 44 and 54' are electrically connected, and conductor 54' (e.g., without limitation, a conductive rod; a conductive plate) is extended from conductor 44. The operating mechanism 28" longitudinally moves the vacuum interrupter 22, insulating cage 24 and conductors 44,54,54' to the position shown in FIG. 6B wherein the conductor 54' is electrically connected to the ground conductor 74'. In this transitional position, the fixed end conductor 44 of the vacuum interrupter 22 is grounded and the vacuum interrupter contacts 32,34 are open.

In FIG. 6C, the vacuum interrupter 22 is in the closed position and the series switch formed by conductors 44,54, 54' and ground terminal 74' is still in the grounded position. Hence, the load side stem 58 is grounded. The operating mechanism 28" closes the fixed contact assembly 50 and the movable contact assembly 52 by moving the movable contact assembly 52 along the longitudinal axis defined by the movable stem 58 toward the fixed contact assembly 50. The load side stem 58 is also electrically connected to the load 72 (FIG. 4A) by a conductor 76 (FIG. 4A). Thus, the load 72 is grounded and may be safely worked on.

The vacuum interrupter disconnect switch 20"", thus, provides three functions: (1) switching (FIGS. 4A and 4B); (2) disconnection (i.e., isolation) (FIG. 6A); and (3) grounding (FIGS. 6B and 6C) using one operating mechanism 28" and one vacuum interrupter 22. From the user standpoint, the most important positions are closed (FIG. 4A), disconnected (FIG. 6A) and grounded (FIG. 6C). Hence, the open (for interruption) position (FIG. 4B) may be a position intermediate the closed position (FIG. 4A) and the disconnected position (FIG. 6A). The operating mechanism 28" returns the vacuum interrupter disconnect switch 20"" from the grounded position (FIG. 6C) to the closed position (FIG. 4A) by following the opposite sequence of positions as sequentially shown in FIGS. 6C, 6B, 6A, 4B and 4A.

EXAMPLE 6

Although, for purposes of safety, the transitional positions of FIGS. 3D, 4D and 6B are needed, the disclosed vacuum circuit interrupters 20,20',20",20''' should not normally be left in those states.

The disclosed vacuum circuit interrupters 20,20',20",20''', 20'''' employ a conventional two-position vacuum interrupter 22. An operating mechanism 28,28' preferably provides: (a) the longitudinal opening motion for the vacuum interrupter contacts 32,34, (b) the longitudinal or rotational motion for the vacuum interrupter 22, insulating cage 24 and conductor 44 for the disconnection function, and (c) the rotational motion for the vacuum interrupter 22, insulating cage 24 and conductor 44 for the grounding function. For example, the rotational motion can be relatively slow as compared to the opening and closing speeds of the vacuum interrupter fixed and movable contacts 32,34. This combines the excellent AC current interruption capability of the vacuum interrupter 22 with the isolation properties of a suitable insulating medium, such as, for example, air, $SF_6$ or oil. Furthermore, the fixed conductor 44 of the vacuum interrupter 22 is employed as a series disconnect switch, thereby eliminating the need to use a separate disconnect switch.

The disclosed vacuum circuit interrupters 20,20',20",20''', 20'''' provide four functions: (1) load energized (vacuum interrupter contacts 32,34 closed; FIGS. 3A and 4A); (2) current interruption (vacuum interrupter contacts 32,34 open; FIGS. 3B and 4B); (2) disconnection (i.e., isolation) (FIGS. 3C, 4C and 6A; fixed conductor 44 of the vacuum interrupter 22 is electrically disconnected); and (4) grounded (FIGS. 3E, 4E, 5 and 6C; vacuum interrupter contacts 32,34 closed and fixed conductor 44 of the vacuum interrupter 22 is electrically grounded).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A vacuum circuit interrupter comprising:

a first conductor;

a vacuum switch comprising:

a second conductor, and a vacuum envelope containing a fixed contact assembly and a movable contact assembly movable between a closed circuit position in electrical connection with the fixed contact assembly and an open circuit position spaced apart from the fixed contact assembly, said second conductor being outside of said vacuum envelope, said second conductor being electrically connected to said fixed contact assembly;

a third conductor electrically connected to said movable contact assembly;

a fourth conductor; and an operating mechanism structured to: open and close the fixed contact assembly and the movable contact assembly of said vacuum switch, and move said vacuum switch and the second conductor thereof between a first position wherein said second conductor is electrically connected to said first conductor, and a second position wherein said second conductor is electrically connected to said fourth conductor.

2. The vacuum circuit interrupter of claim 1 wherein said fourth conductor is a ground conductor.

3. The vacuum circuit interrupter of claim 1 wherein said first conductor is a line conductor; and wherein said third conductor is a load conductor.

4. The vacuum circuit interrupter of claim 3 wherein said fourth conductor is a ground conductor.

5. The vacuum circuit interrupter of claim 1 wherein said vacuum switch is a vacuum interrupter.

6. The vacuum circuit interrupter of claim 1 wherein the movable contact assembly of said vacuum switch includes a longitudinal axis; wherein said operating mechanism is structured to, first, open the fixed contact assembly and the movable contact assembly by moving said movable contact assembly along said longitudinal axis and away from said fixed contact assembly and to, second, rotate said vacuum switch and the second conductor thereof away from the first position wherein said second conductor is electrically connected to said first conductor and toward the second position wherein said second conductor is electrically connected to said fourth conductor.

7. The vacuum circuit interrupter of claim 6 wherein said operating mechanism is further structured to, third, close the fixed contact assembly and the movable contact assembly by moving said movable contact assembly along said longitudinal axis and toward said fixed contact assembly.

8. The vacuum circuit interrupter of claim 1 wherein the movable contact assembly of said vacuum switch includes a longitudinal axis; wherein said operating mechanism is structured to, first, open the fixed contact assembly and the movable contact assembly by moving said movable contact assembly along said longitudinal axis and away from said fixed contact assembly, to, second, move said vacuum switch and the second conductor thereof along said longitudinal axis and away from said first conductor, and to, third, rotate said vacuum switch and the second conductor thereof toward the second position wherein said second conductor is electrically connected to said fourth conductor.

9. The vacuum circuit interrupter of claim 8 wherein said operating mechanism is further structured to, fourth, close the fixed contact assembly and the movable contact assembly by moving said movable contact assembly along said longitudinal axis and toward said fixed contact assembly.

10. The vacuum circuit interrupter of claim 2 wherein said operating mechanism is structured to provide movement among:

a closed position wherein said second conductor is electrically connected to said first conductor and the fixed contact assembly is electrically connected to the movable contact assembly of said vacuum switch, an open position wherein said second conductor is electrically connected to said first conductor and the fixed contact assembly is electrically disconnected from the movable contact assembly of said vacuum switch, a disconnected position wherein said second conductor is electrically disconnected from said first conductor and the fixed contact assembly is electrically disconnected from the movable contact assembly of said vacuum switch, a transitional position wherein said second conductor is electrically disconnected from said first conductor, the fixed contact assembly is electrically disconnected from the movable contact assembly of said vacuum switch, and said second conductor is electrically connected to said fourth conductor, and a grounded position wherein said second conductor is electrically disconnected from said first conductor, the fixed contact assembly is electrically connected to the movable contact assembly of said vacuum switch, and said second conductor is electrically connected to said fourth conductor.

11. The vacuum circuit interrupter of claim 2 wherein said operating mechanism is structured to provide movement among:

a closed position wherein said second conductor is electrically connected to said first conductor and the fixed contact assembly is electrically connected to the movable contact assembly of said vacuum switch, a disconnected position wherein said second conductor is electrically disconnected from said first conductor and the fixed contact assembly is electrically disconnected from the movable contact assembly of said vacuum switch, and a grounded position wherein said second conductor is electrically disconnected from said first conductor, the fixed contact assembly is electrically connected to the movable contact assembly of said vacuum switch, and said second conductor is electrically connected to said fourth conductor.

12. The vacuum circuit interrupter of claim 1 wherein the movable contact assembly of said vacuum switch includes a longitudinal axis; wherein said operating mechanism is structured to, first, open the fixed contact assembly and the movable contact assembly by moving said movable contact assembly along said longitudinal axis and away from said fixed contact assembly, to, second, move said vacuum switch and the second conductor thereof along said longitudinal axis and away from said first conductor, and to, third, further move said vacuum switch and the second conductor thereof along said longitudinal axis, away from said first conductor and toward the second position wherein said second conductor is electrically connected to said fourth conductor.

13. A vacuum circuit interrupter comprising:

a first conductor including a contact portion;

a vacuum switch comprising:

a first vacuum envelope containing a fixed contact assembly and a movable contact assembly movable between a closed circuit position in electrical connection with the fixed contact assembly and an open circuit position spaced apart from the fixed contact assembly, and a second conductor electrically connected to said fixed contact assembly, said second conductor including a contact portion;

a third conductor electrically connected to said movable contact assembly;

a fourth conductor including a contact portion, the contact portions of said first, second and fourth conductors being outside of said vacuum envelope;

an operating mechanism structured to: open and close the fixed contact assembly and the movable contact assembly of said vacuum switch, and move said vacuum switch and the second conductor thereof between a first position wherein the contact portion of said second conductor is electrically connected to the contact portion of said first conductor, and a second position wherein said the contact portion of second conductor is electrically connected to the contact portion of said fourth conductor; and a second envelope containing at least the contact portions of said first, second and fourth conductors.

14. The vacuum circuit interrupter of claim 13 wherein said second envelope further contains an insulating medium.

15. The vacuum circuit interrupter of claim 14 wherein said insulating medium is air.

16. The vacuum circuit interrupter of claim 14 wherein said insulating medium is oil.

17. The vacuum circuit interrupter of claim 14 wherein said insulating medium is sulfur hexafluoride.

18. The vacuum circuit interrupter of claim 13 wherein the movable contact assembly of said vacuum switch includes a longitudinal axis; wherein said operating mechanism is structured to, first, open the fixed contact assembly and the movable contact assembly by moving said movable contact assembly along said longitudinal axis and away from said fixed contact assembly and to, second, rotate said vacuum switch and the contact portion of the second conductor thereof away from the first position wherein the contact portion of said second conductor is electrically connected to the contact portion of said first conductor and toward the second position wherein the contact portion of said second conductor is electrically connected to the contact portion of said fourth conductor.

19. The vacuum circuit interrupter of claim 18 wherein said operating mechanism is further structured to, third, close the fixed contact assembly and the movable contact assembly by moving said movable contact assembly along said longitudinal axis and toward said fixed contact assembly.

20. The vacuum circuit interrupter of claim 13 wherein the movable contact assembly of said vacuum switch includes a longitudinal axis; wherein said operating mechanism is structured to, first, open the fixed contact assembly and the movable contact assembly by moving said movable contact assembly along said longitudinal axis and away from said fixed contact assembly, to, second, move said vacuum switch and the contact portion of said second conductor thereof along said longitudinal axis and away from the contact portion of said first conductor, and to, third, rotate said vacuum switch and the contact portion of said second conductor thereof toward the second position wherein the contact portion of said second conductor is electrically connected to the contact portion of said fourth conductor.

21. A vacuum circuit interrupter comprising:

a first conductor;

a vacuum switch comprising:

a second conductor, a vacuum envelope including a first end and a second end, said vacuum envelope containing a fixed contact assembly proximate the first end of said vacuum envelope and substantially containing a movable contact assembly proximate the second end of said vacuum envelope, said movable contact assembly movable between a closed circuit position in electrical connection with the fixed contact assembly and an open circuit position spaced apart from the fixed contact assembly, said second conductor being outside of said vacuum envelope, said second conductor being electrically connected to said fixed contact assembly, a first member outside of said vacuum envelope, said first member being structured to support the first end of said vacuum envelope, a second member outside of said vacuum envelope, said second member being structured to support the second end of said vacuum envelope, and a number of insulating support members outside of said vacuum envelope and disposed between said first and second members;

a third conductor electrically connected to said movable contact assembly;

a fourth conductor; and an operating mechanism structured to: open and close the fixed contact assembly and the movable contact assembly of said vacuum switch, and move said vacuum switch and the second conductor thereof between a first position wherein said second conductor is electrically connected to said first conductor, and a second position wherein said second conductor is electrically connected to said fourth conductor.

22. The vacuum circuit interrupter of claim 21 wherein said first member includes a first opening; wherein said second member includes a second opening; wherein said second conductor passes through the first opening of said first member; and wherein a portion of said movable contact assembly passes through the second opening of said second member.

* * * * *